US005136127A

United States Patent [19]

Blair

[11] Patent Number: 5,136,127

[45] Date of Patent: Aug. 4, 1992

[54] TILT ACTUATED SWITCH

[75] Inventor: Carl D. Blair, Freeport, Ill.

[73] Assignee: Honeywell Inc., Minneapolis, Minn.

[21] Appl. No.: 759,265

[22] Filed: Sep. 16, 1991

[51] Int. Cl.[5] ..... H01H 35/02; H01H 35/14

[52] U.S. Cl. ..... 200/61.52; 200/61.45 R

[58] Field of Search ..... 200/61.52, 61.45 R, 200/DIG. 29

[56] References Cited

U.S. PATENT DOCUMENTS

| | | | |
|---|---|---|---|
| 4,001,185 | 1/1977 | Mitsui et al. | 200/61.45 R |
| 4,135,067 | 1/1979 | Bitko . | |
| 4,297,683 | 10/1981 | Roberts . | |
| 4,467,154 | 8/1984 | Hill . | |
| 4,618,746 | 10/1986 | Schwob et al. . | |
| 4,628,160 | 12/1986 | Canevari . | |
| 4,686,335 | 8/1987 | Grant . | |
| 4,833,281 | 5/1989 | Maples . | |

*Primary Examiner*—Harold Broome
*Attorney, Agent, or Firm*—William D. Lanyi

[57] ABSTRACT

A tilt switch is provided which incorporates first and second conductive end caps that are disposed apart by a predetermined amount to define a gap between the inwardly directed end faces of the end caps. A nonconducting member is used to provide the appropriate spacing of the first and second end caps and a conductive sphere is disposed between end caps in the region of the predefined gap. The sphere is supported by first and second support edges which are the result of the interface between cylindrical surfaces of the generally tubular end caps and the end faces of the end caps which are arranged to face each other. When the switch is generally horizontal, the sphere bridges the gap between the support edges and provides electrical continuity between the first and second end caps. When the switch is tilted, the sphere moves out of contact with one of the support edges and breaks the electrical communication between the end caps. The movement of the sphere from a first position to a second position is accomplished by the sphere pivoting about one of the support edges while remaining in continual contact with the support edge that is used as a pivot. During normal operation the sphere does not roll within the switch and therefore is not susceptible to many of the problems associated with tilt switches which utilize rolling spheres.

19 Claims, 7 Drawing Sheets

TILT ACTUATED SWITCH

BACKGROUND OF THE INVENTION

1. Field of the Invention:

The present invention is generally related to a switch which is actuated in response to a change in its attitude or tilt and, more particularly, to a tilt switch which utilizes a conductive sphere which pivots about one of two support edges between two positions in which one position completes an electrical circuit by bridging the gap between the two support edges and another position breaks the electrical circuit by moving out of contact relation with one of the two support edges.

2. Description of the Prior Art:

Many different types of tilt switches are known to those skilled in the art. Some tilt switches are intended to detect very slight changes in the attitude of the switch and respond to small changes in the angle of tilt. For example, the well known Mercury switch is used in both residential and commercial thermostats and can detect changes in attitude as small as one or two degrees. Other types of tilt switches are intended to discern much larger changes in the angle of tilt. For example, certain vehicles can be provided with tilt switches which break an electrical circuit and deprive motive power to a vehicle when that vehicle leans beyond an acceptable angle. This type of tilt switch can be used as a safety precaution on vehicles, such as bulldozers or tractors, which can be made to operate on steeply sloped terrain. Although a wide variety of switches of these types are very well known to those skilled in the art, only a select few will be discussed herein.

U.S. Pat. No. 4,628,160, which issued to Canevari on Dec. 9, 1986, discloses an electrical tilt switch that comprises a generally cylindrical cap member that has a hollow interior with an internal inwardly extending ridge that is positioned a significant distance above its lower edge. It also comprises a generally cylindrical base member that has a concave upper face. An annular insulating member is interposed between the base and the cap and the three components are fastened together. Inside this assembly, a spherical contact member is carried on the dished surface of the base and is moveable by rolling against the ridge when the switch is tilted beyond a predetermined angle.

U.S. Pat. No. 4,833,281, which issued to Maples on May 23, 1989, describes a motion detector that is adapted for use with the transmitter of a motor vehicle keyless entry system. It causes the transmitter device carried by the user to transmit a coded signal when it is in motion, for example, as it is being carried by a user toward the vehicle. The motion detector includes a spool disposed within and electrically insulated from a shell. A ball is positioned in the annular cavity around the spool. An electronic circuit is provided to sense a change in state of the motion detector as an indication of motion. These changes of state of the motor detector occur when the ball moves into and out of direct contact with the spool or shell and further as the ball rolls around the annular cavity while being supported by both the spool and shell caused by surface roughness of the interior surfaces.

U.S. Pat. No. 4,297,683, which issued to Roberts on Oct. 27, 1981, describes a vandal alarm system for parking meters to prevent the unauthorized entry into the coin box area of a parking meter and to prevent the striking of the housing as well as the bending of the support pipe. A radio transmitter is adapted to send signals to a receiver which is constantly turned on. The received signal indicates unauthorized entry or vandalism to parking meter and to the particular parking meter from which the signal is sent. Switches are actuated at an opening of the timer compartment and/or coin box area. A switch is also actuated while the supporting post is bent. A timer is placed in this circuit so that only after a determined time period is a signal sent of the bending of the post.

U.S. Pat. No. 4,135,067, which issued to Bitko on Jan. 16, 1979, discloses a tilt switch that includes an enclosure for a gravity response conductive ball. An annular shelf surrounds a central depression where at least one switch contact passing into the housing is exposed. The shelf is operable to support the ball in a position resting against a cup-shaped portion of the switch housing with the ball centroid located within an imaginary right cylinder having the inner shell periphery as a base. In response to the tilting of the switch, the ball is movable away from the cup-shaped housing to the depression where it engages the contact and closes a circuit between that and another contact.

U.S. Pat. No. 4,618,746, which issued to Schwob et al on Oct. 21, 1986, describes a ball actuated position sensitive switch that is multi-directional. It comprises a housing in which at least two electrical contacts are arranged opposite to one another. A tilting member is supported in the housing by means of a tilting part and has a control part extending in the vicinity of one of the electrical contacts. A ball is carried by a surface of the tilting member that is opposite the tilting part. The tilting member has a profile in the form of a cup.

U.S. Pat. No. 4,467,154, which issued to Hill on Aug. 21, 1984, describes a gravity switch that comprises a molded cup-shaped dielectric member and a cup-shaped conductor member which are pressed together to comprise a integral dimensionally stable sealed enclosure for a contact member that is moveable axially therein for selectively making or breaking an electrical connection between the cup-shaped conductor member and a second conductor extending axially through and sealed with the base of the cup-shaped dielectric member. The outer surfaces of the base and the second conductor comprise electrical contacts for a gravity actuated switch. The overall axial dimension between the axially outer surfaces is obtained by telescoping the cup-shaped members coaxially together until the preselected axially dimension is obtained.

U.S. Pat. No. 4,686,335, which issued to Grant on Aug. 11, 1987, discloses a shock sensor switch that is vibration sensitive and comprises a pair of spaced apart parallel contacts housed in a switch body and a movably supported activated mass inside a chamber in the body. The mass is supported by conductive members in the form of a pair of bars secured in the mass and located between the two contacts with the center of gravity of the mass spaced from the points of contact between the contacts and the bars so that bars are urged against the contacts by a lever action as a result of the gravitational force acting on the mass. The forces at the contact points are thus greater than that which would be obtained by simply allowing the mass to rest on the contacts, which enables a relatively small mass to be used having a greater sensitivity to high frequency vibrations.

Many problems exist with regard to the manufacture and use of the tilt switches which are presently known to those skilled in the art. For example, certain applications require that electrical currents flow through a spherical conductor which is moveable and one or more stationary conductors. To accomplish this function, tilt switches generally require that the spherical conductor roll along a predefined path to move from a conductive position to a nonconductive position, and back again. However, when electrical current is made or broken by the spherical conductor moving into contact or out of contact with a stationary conductor, it is common for arcing to occur. This arcing can create pitting on the surface of the sphere. The pitting can then interfere with the smooth rolling of the conductive sphere during later cycles of its operation. Another problem with existing tilt switches is the cost of manufacture and assembly which is often prohibitive in applications that require inexpensive switches to permit the application to be economically justifiable.

It would therefore be advantageous for a tilt switch to be easily and inexpensively manufacturable while avoiding the need for a spherical member to roll along another surface within the switch.

SUMMARY OF THE INVENTION

The present invention provides a tilt switch which, in its preferred embodiment, comprises a first end cap which is electrically conductive and which has a first support edge. A second end cap, which is also electrically conductive, comprises a second support edge. The first and second end caps are associated together with their first and second support edges extending toward each other and spaced apart to define a predetermined gap therebetween. A conductive sphere is disposed between the first and second end caps. The sphere is moveable, in response to a change in attitude of the switch, between a first position and a second position wherein the first position is defined by the sphere being in electrical contact with both of the first and second support edges and being supported by the first and second support edges to bridge the gap therebetween. The second position of this sphere is defined by the sphere being in electrical noncontact with the second support edge. The conductive sphere is pivotable about the first edge between the first and second positions.

In a particularly preferred embodiment of the present invention, the first and second conductive end caps are spaced apart to define the gap by incorporating a nonconductive central member disposed between and attached to both the first and second conductive end caps. In the most preferred embodiment of the present invention, the nonconductive central member is a hollow tube which is made of either plastic or a ceramic material.

The preferred embodiment of the present invention comprises first and second end caps which are generally cylindrical and which each have a inner cylindrical surface which defines an edge portion at the inwardly extending terminus of the cylindrical surface. When the two support edges are disposed proximate each other, with a predefined gap therebetween, a sphere can be supported on and between the support edges to bridge the gap and provide electrical communication between the support edges of the associated first and second electrically conductive end caps. If the switch is tilted beyond a predefined angle, the conductive sphere pivots about one of the two support edges and moves out of contact with the other support edge. As the sphere moves out of contact with the other support edge, the two end caps are electrically disconnected from each other.

The tilt switch of the present invention can be disposed in electrical series relation with a source of electrical power and with a lamp. With the first and second conductive end caps disposed in this serial relationship, the presence of the conductive sphere in bridging relation across the first and second support edge will cause the circuit to be completed and permit the lamp to receive electrical energy from the power source. However, if the tilt switch is tilted beyond a predefined angle, the conductive sphere will move out of contact with one of the support edges and the serial circuit will be broken to deprive the lamp of power from the power source.

BRIEF DESCRIPTION OF THE DRAWINGS

The present invention will be more fully understood from a reading the Description of the Preferred Embodiment in conjunction with the drawings, in which.

DESCRIPTION OF THE PREFERRED EMBODIMENT

Figure 1:
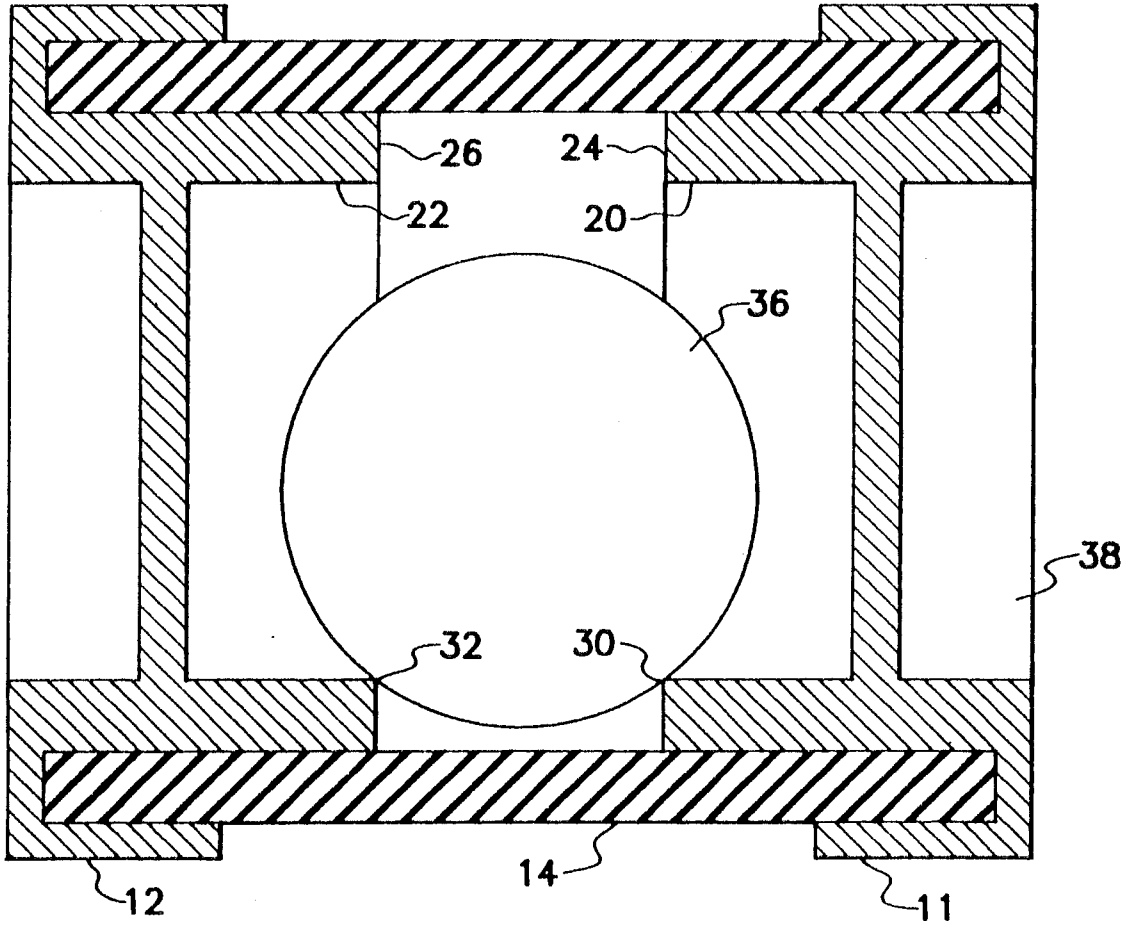
FIG. 1 shows a cross sectional view of the generally cylindrical preferred embodiment of the present invention.

Throughout the Description of the Preferred Embodiment, like components will be identified with like reference numerals and letters.

FIG. 1 shows a preferred embodiment of the switch 10 of the present invention. A first conductive end cap 11 is connected to a second conductive end cap 12 by a spacer which, in the embodiment illustrated in FIG. 1, is a nonconductive tube 14 which is attached to both the first and second conductive end caps. The end caps are generally cylindrical in shape and each end cap comprises an inner cylindrical surface. The first end cap 11 has a first inner cylindrical surface 20 and the second end cap 12 has a second inner cylindrical surface 22. Where the first cylindrical surface 20 meets an end face 24 of the first end cap 11, a first edge exists. Similarly, where the second cylindrical surface 22 meets the second end face 26, a second edge exists. These edges, which are identified by reference numerals 30 and 32, respectively, provide support for a conductive sphere 36 which is disposed within the generally cylindrical opening of the switch.

As can also be seen in FIG. 1, the first and second end caps are provided with annular grooves which are shaped to receive the axial ends of the tube 14. The depth of the annular grooves in the end caps and the overall axial length of the tube 14 are predetermined to result in the end faces 24 and 26 of the end caps being disposed a predetermined distance apart. The means for determining the desired distance, or gap, between the end faces of the first and second end caps, in association with the diameter of the conductive sphere 36, will be described in greater detail below.

As shown in FIG. 1, the axially outboard ends of the end caps are also provided with cylindrical openings therein. For example, the first end cap 11 is provided with a cylindrical depression 38 in its outboard surface. These depressions are not a requirement of the present invention but, instead, are utilized in one particular embodiment of the present invention to provide an appropriate seat for electrical contact with either a spring or a lamp of a particular lamp fixture. The space surrounding the sphere 36 within the sealed switch can be filled with a gas, such as air or an appropriate inert gas, or alternatively, may be filled with a nonconductive liquid in certain particular applications.

Figure 2:
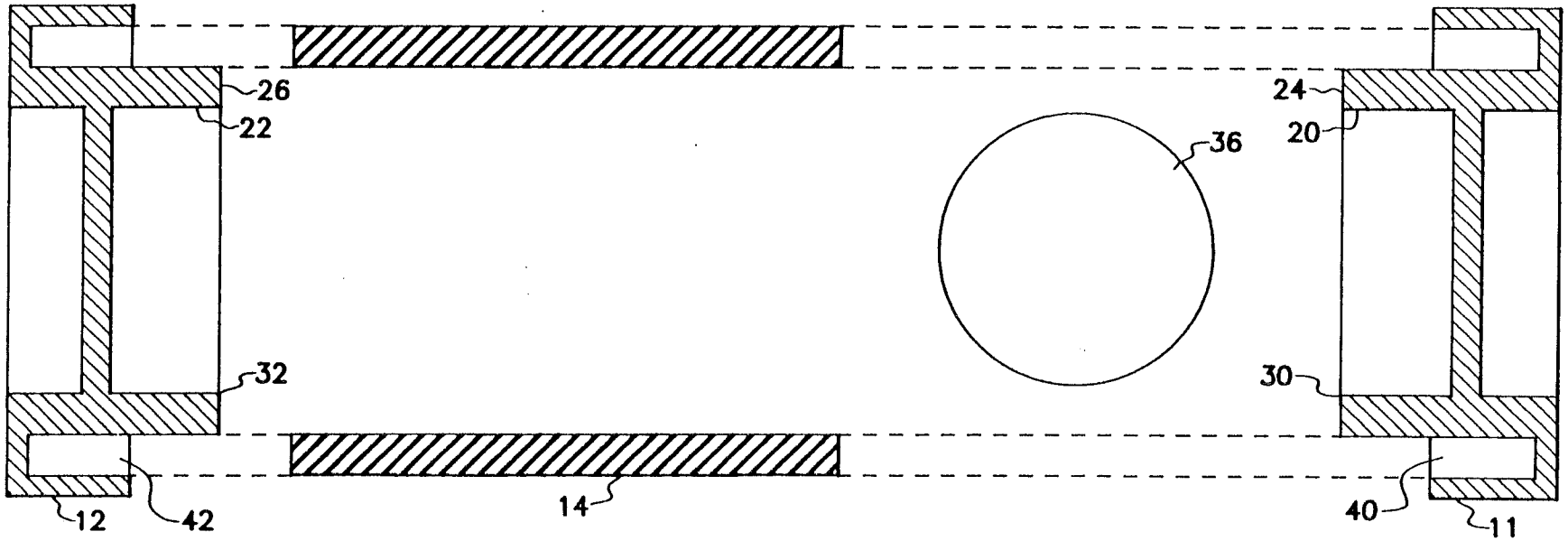
FIG. 2 shows an exploded view of the switch of FIG. 1.

FIG. 2 illustrates an exploded view of the present invention showing the switch of FIG. 1 with its component parts disconnected from each other. One axial end of the nonconductive tube 14 is shaped to be received in the annular groove 40 of the first end cap 11. The other axial end of the nonconductive tube 14 is shaped to be received in an annular groove 42 of the second conductive end cap 12. Before attaching the end caps to the tube 14, a spherical conductor 36 is disposed within the central opening of the tube 14.

Although the embodiment shown in FIG. 2 comprises nonconductive tube 14 to connect the first and second end caps together and provide the proper spacing therebetween, it should be understood that alternative embodiments of the present invention could utilize means for performing these functions other than a nonconductive tube.

In FIG. 2, the cooperation between the inner cylindrical surfaces, 20 and 22, and the end faces, 24 and 26, to form the support edges, 30 and 32, can be seen. If the end faces, 24 and 26, are spaced apart by a predetermined gap which is less than the diameter of the sphere 36, the conductive sphere 36 can be supported by the support edges, 30 and 32. It should also be understood that the height of the support edges, 30 and 32, above the inner cylindrical surface of the tube 14, must also be taken into consideration when determining the dimensions of the switch components. For example, if the gap between the end faces, 24 and 26, is too great, the sphere 36 may move downward into contact with the inner cylindrical surface of the nonconductive tube 14 and will therefore not be in bridging association with the first and second support edges, 30 and 32. These details will be described in greater detail below in association with FIG. 7. In addition, alternative connectors, other than the nonconductive tube 14, can be used to space the first and second end caps apart. If a tube is not utilized for this function, the above described dimensional problem may not exist.

Figure 3A:
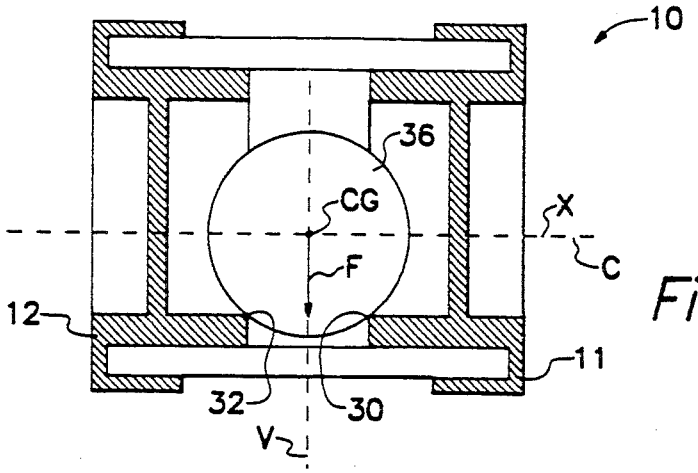
FIGS. 3A–3C show successive configurations of the present invention during a tilting actuation.

With reference to FIGS. 1 and 3A, it can be seen that FIG. 3A is a reproduction of the illustration of FIG. 1 with the additional reference lines to indicate the vertical and horizontal directions relative to the attitude of the switch. FIG. 3A shows the switch 10 disposed with its axial centerline being generally parallel to a horizontal line identified by reference letter X in FIG. 3A. To facilitate this description, a line parallel to the axial centerline is identified by reference letter C and is drawn through the center of gravity of the sphere 36 for purposes of this illustration. However, it should be clearly understood that the actual centerline of the overall switch 10, would not pass through the center of gravity CG, but would be parallel to line C and above the position of line C in FIG. 3A. The horizontal line is drawn through the center of gravity of the sphere 36, as is the vertical line V, so that the relative movements of the switch and the sphere can be more easily described.

With continued reference to FIG. 3A, it can be seen that the force vector F, due to the weight of the sphere, extends from the center of gravity CG downward in a vertical direction between the support edges 30 and 32. This provides a stable support for the sphere and maintains continual electrical communication between the first conductive end cap 11 and the second conductive end cap 12.

Figure 3B:
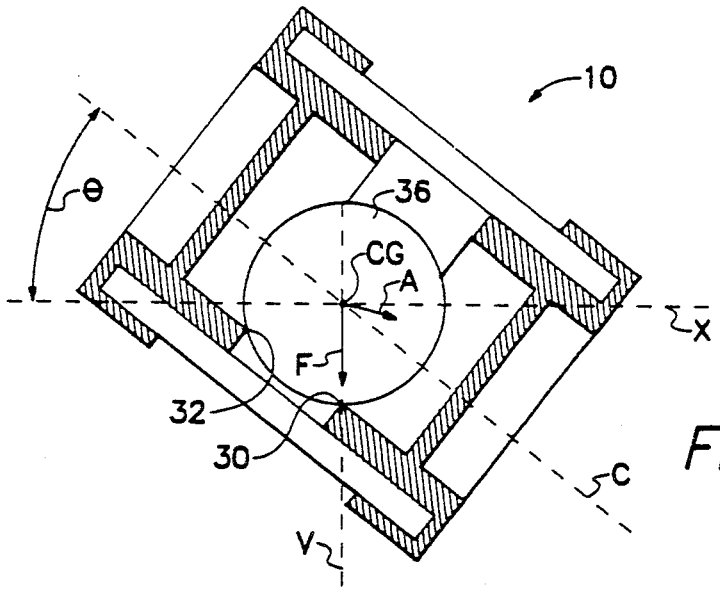

FIG. 3B illustrates the switch 10 as it begins to move away from the horizontal attitude illustrated in FIG. 3A. As the switch 10 pivots and its central axis C moves away from the horizontal line X, the vector F continues to point in a vertically downward direction while the first and second support edges, 30 and 32, move away from their original positions relative to the force vector F. Eventually, the force vector F will point downward directly through support edge 30. This occurs when the center of gravity CG of the sphere 36 is directly above the support edge 30. This condition is shown in FIG. 3B. The situation shown in FIG. 3B illustrates that the switch 10 has rotated from a horizontal position by an angular displacement identified by $\theta$. When the switch is in the condition shown in FIG. 3B, it is unstable and is supported solely by the single support edge 30. Any slight additional movement to increase the tilt beyond the magnitude of angle $\theta$ will cause the center of gravity CG of the sphere 36 to move to the right of a vertical line passing through the support edge 30 and will create an unstable condition. This unstable condition will cause the sphere 36 to pivot about the support edge 30 in a direction indicated by arrow A in FIG. 3B.

Figure 3C:
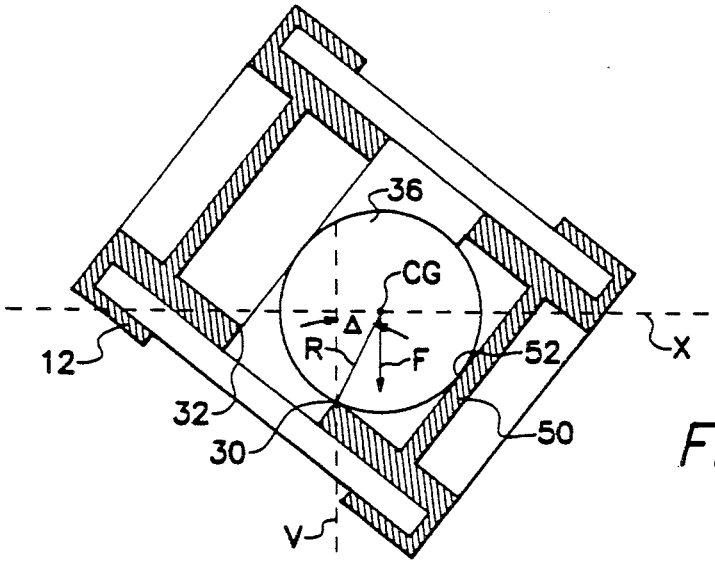

If the sphere 36 moves in the direction indicated by arrow A in FIG. 3B, it will pivot about the support edge 30 and move to a position of lowest potential energy which is illustrated in FIG. 3C. After the center of gravity CG of the sphere 36 moves to the right of the vertical line V, the sphere 36 will continue to pivot about the support edge 30 until it is stopped by some object or external force. In this case, the sphere 30 stops its pivoting about support edge 30 because it moves into contact with the wall 50 at a contact point identified by reference numeral 52 in FIG. 3C. When the sphere 36 moves into this second position, it again becomes stable because the force vector F passe vertically downward between the support edge 30 and the support point 52.

In the terminology used above, the sphere 36 is moveable between a first position which is illustrated in FIG. 3A and a second position which is illustrated in FIG. 3C. In other words, the first position is defined by the sphere 36 being supported by the first and second support edges, 30 and 32, and in bridging contact between the first and second end caps, 11 and 12. The second position is defined by the sphere 36 being in noncontact association with on of the support edges. In FIG. 3C, the sphere 36 is in noncontact association with support edge 32 of the second end cap 12. The geometric considerations regarding the movement from the first position to the second position will be described in greater detail below in association with FIG. 4.

Figure 4:
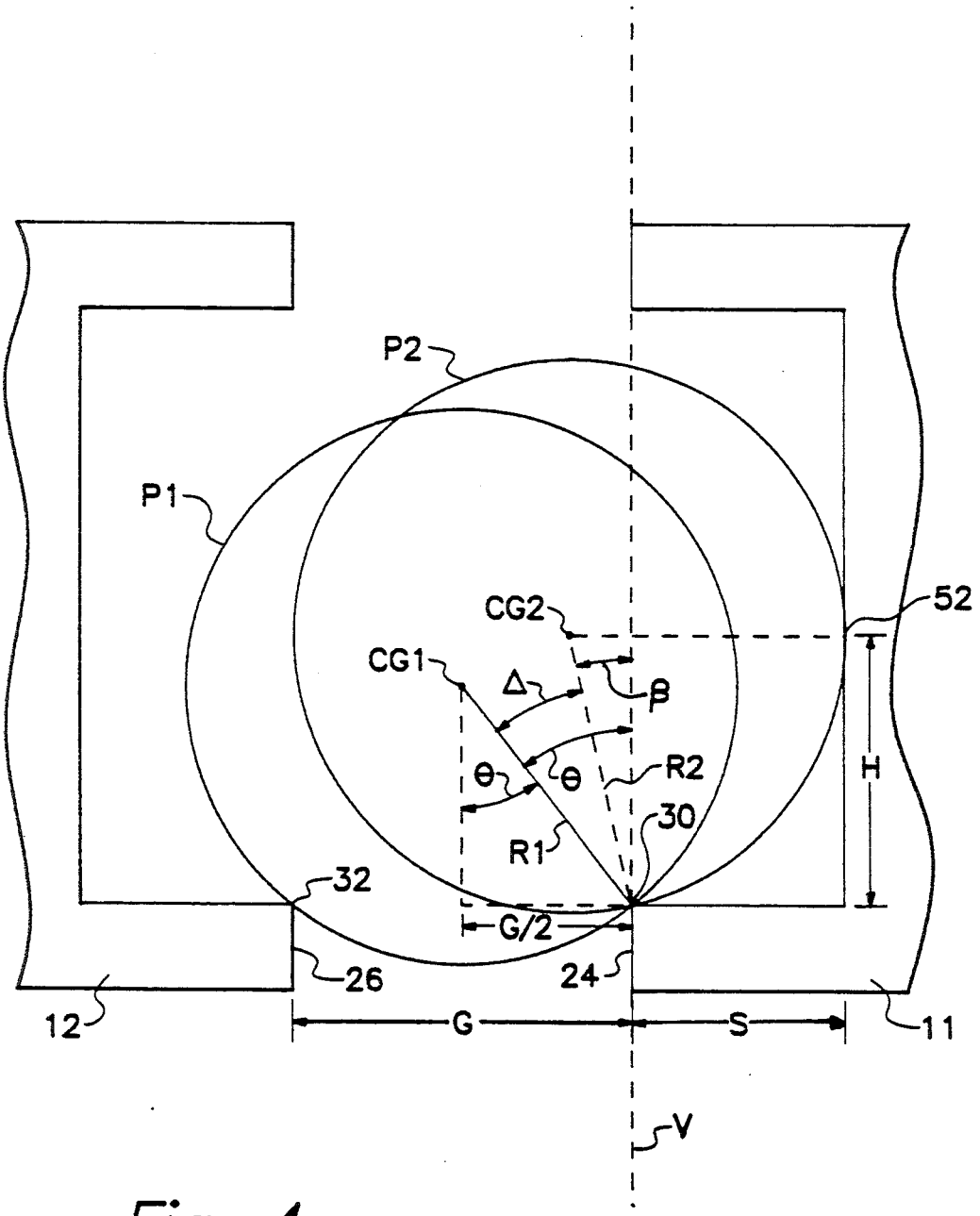
FIG. 4 is an exemplary schematic illustration of the geometric relationships within the present invention.

For purposes of this discussion, FIG. 4 shows only the relevant portions of the first end cap 11 and the second end cap 12. In addition, the sphere 36 is illustrated by dashed lines representing its first position P1 and its second position P2. Although these two positions of the sphere result from tilting of the switch and its first and second end caps, the movement of the sphere will be described in association with FIG. 4 although FIG. 4 illustrates the first and second end caps as remaining in the basic horizontal position for the switch. The purpose of FIG. 4 is to illustrate the geometric relationships between the dimensions of the components.

As can be seen in FIG. 4, a rotation equal to a magnitude of $\theta$ degrees is necessary to move the center of gravity CG1 of the sphere from its location CG1 at position P1 to a point vertically above the first support edge 30. The magnitude of angle $\theta$ is equal to the arcsine of the ratio G/2R where R is the radius of the sphere 36 and G is the distance, or gap, between the end faces, 24 and 26, of the first and second end caps, 11 and 12. This geometric relationship can be seen in FIG. 4.

When the switch 10 pivots more than the magnitude of $\theta$ degrees from its horizontal position, the center of gravity of the sphere will move from the point identified as CG1 to the point identified as CG2 because of the movement described above in conjunction with FIGS. 3B and 3C. When the sphere moves to position P2, it is supported by the first support edge 30 and a support point 52 which is defined by dimensions S and H. Angle $\beta$ illustrates the location of the center of gravity CG2 of position P2 relative to the support point 52 and the support edge 30, between a radial line R2 and a vertical line V. The relationship of these dimensions, which is easily derived geometrically from the illustration in FIG. 4, defines angle $\beta$ as being equal to the arctangent of the quantity $(R-S)/H$ where R is the radius of the sphere 36, S is the distance between the support edge 30 and the support point 52, measured in a direction parallel to the central axis of the switch, and H is the height between the support edge 30 and the support point 52 measured in a direction perpendicular to the central axis of the switch. In FIG. 4, it can be seen that the distance between CG2 and the support point 52 is equal to the radius R of the sphere. Furthermore it can also be seen that the distance between CG2 and line V is equal to the radius R minus the distance S.

Figure 5:
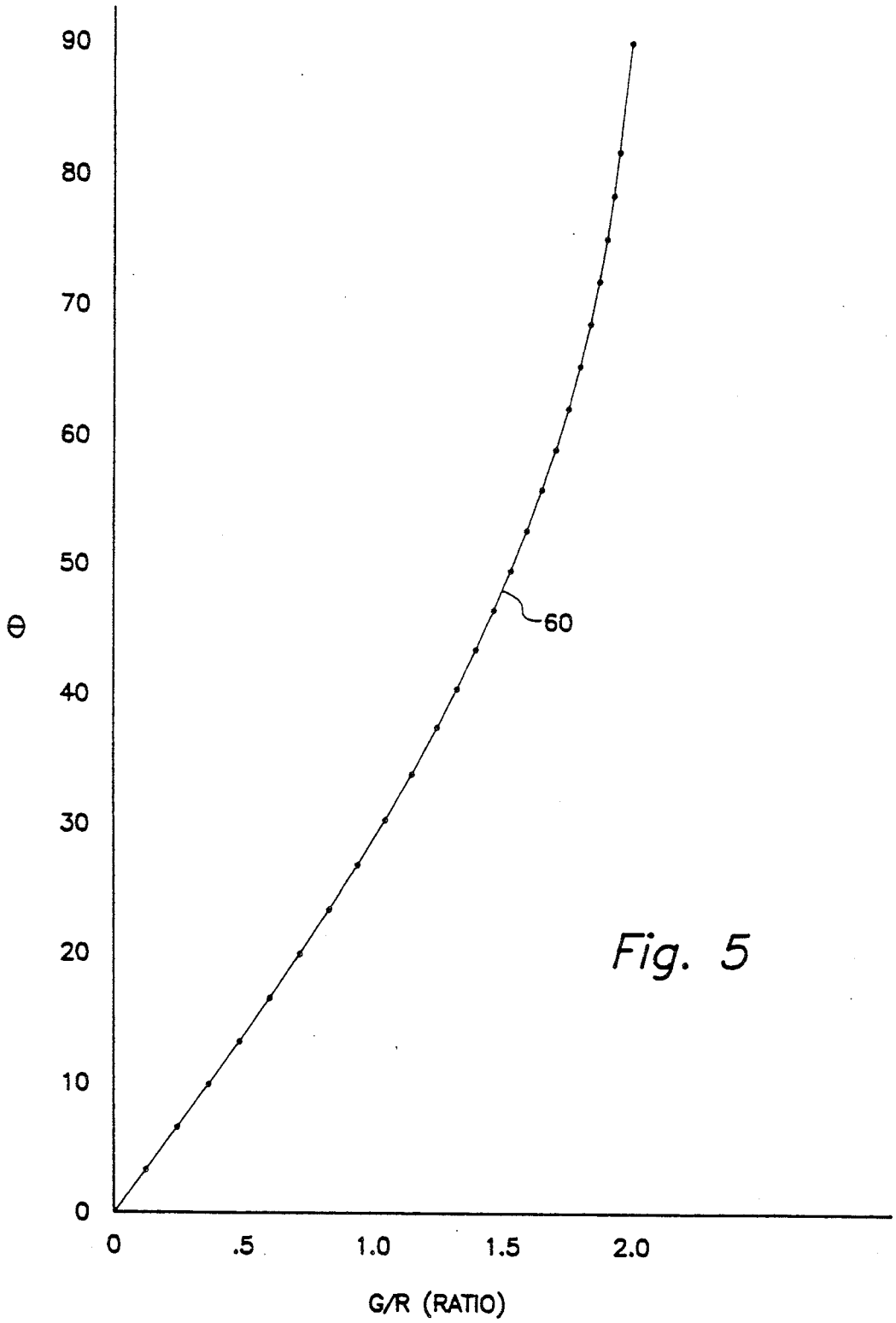
FIG. 5 is the relationship between the actuation angle and the gap/radius ratio.

With reference to FIGS. 4 and 5, the relationship between gap G and radius R of the sphere can be seen along with their effect on the magnitude of the actuation angle $\theta$. The horizontal axis in FIG. 5 represents the ratio of the gap G to the radius R of the sphere and the vertical axis in FIG. 5 represents the magnitude of angle $\theta$. As can be seen, the ratio of G/R varies from 0 to 2.0 for the reasons described above and the magnitude of angle $\theta$ varies from 0 degrees to 90 degrees. It should be noted that line 60 in FIG. 5 is generally linear for a relatively significant portion of its length and for values of G/R up to approximately 1.50. Therefore, it can be seen that by varying the ratio between the gap distance G and the radius of the sphere, the magnitude of angle $\theta$, at which the sphere moves out of contact with support edge 32, can be set to virtually any angle between 0 and 90 degrees. The magnitude of angle $\theta$ represents the angle from horizontal at which the switch 10 will break contact between the first and second conductive end caps.

Figure 6:
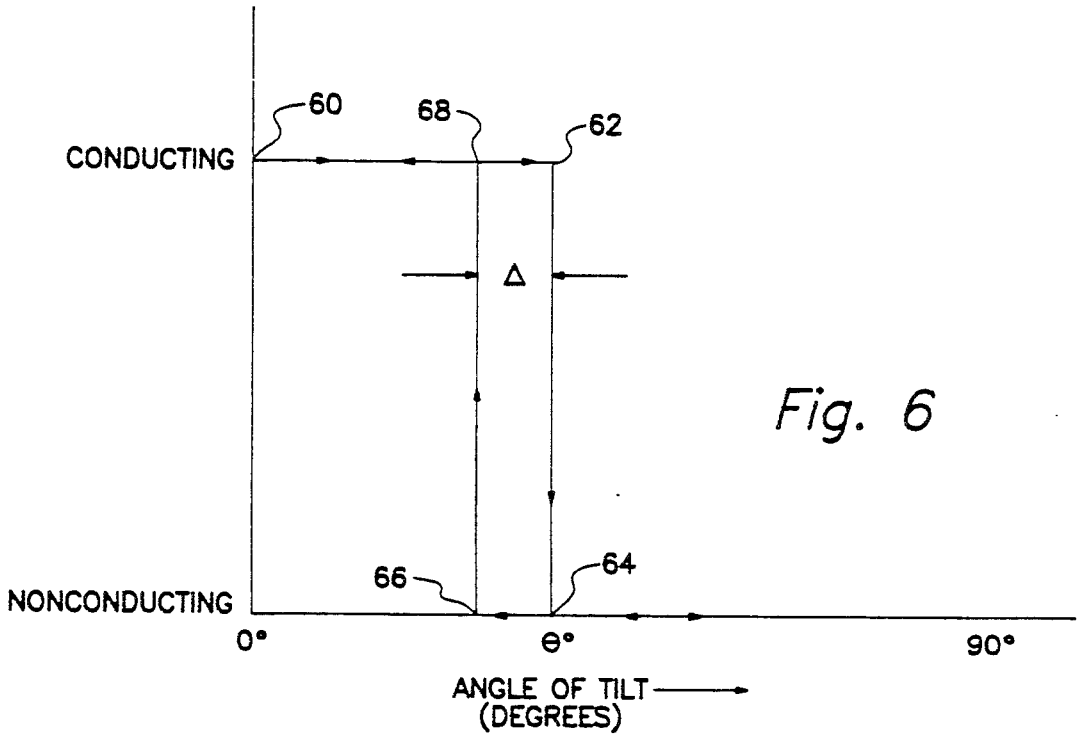
FIG. 6 illustrates the hysteresis of the present invention.

With reference to FIGS. 4 and 6, it should be realized that the switch 10 of the present invention provides a predetermined magnitude of hysteresis between the angular position when contact between the first and second support edges, 30 and 32, is broken to the angular magnitude when that electrical contact is made in response to a reverse rotation of the switch back toward its original horizontal position. In other words, a rotation of the switch in FIG. 4 from a horizontal position to a position in which its center of gravity is slightly more than directly above support edge 30 will cause the sphere to continue to move the additional distance identified by angle $\Delta$ without any further movement of the switch. The movement identified by angle $\Delta$ will result from the force of gravity on the sphere and the fact that the vertical force vector extending from the center of gravity of the sphere is outside of the length of the support base defined by the first and second support edges. This condition is unstable and causes the sphere to continue to move in the direction identified by arrow A in FIG. 3B. The movement which continues beyond the initial unstable position identified in FIG. 3B defines the magnitude of the hysteresis provided by the switch. In other words, to move from the position shown in FIG. 3C to a position where the center of gravity has a vector extending vertically downward to the left of the pivot provided by the first support edge 30, the switch 10 must move at least $\Delta$ degrees back towards its horizontal position. This is true even if the switch 10 is moved in a clockwise direction beyond the magnitude of angle $\theta$ shown in FIG. 3B. This movement identified by angle $\Delta$ is the hysteresis of the switch.

FIG. 6 illustrates the relationship between the angle of tilt of the switch and the conducting or nonconducting status of the switch. Beginning at 0 degrees of tilt at the point identified by reference numeral 60, the angle of tilt can be increased until the angle of tilt reaches a magnitude of $\theta$ degrees, as identified by reference numeral 62 in FIG. 6. At this point, the center of gravity of the sphere is directly above the first support edge 30 and the switch is in the condition represented by the illustration in FIG. 3B. Any slight additional rotation which increases the magnitude of the angle of tilt beyond angle $\theta$ will cause the sphere to move in a clockwise pivoting direction about the support edge 30 and into a nonconducting status as represented by reference numeral 64 in FIG. 6. Any further clockwise rotation of the switch will merely increase the angle of tilt beyond $\theta$ degrees without changing the conducting status of the switch. However, if the switch begins to move in an opposite direction, to return towards its horizontal position, a movement to an angular position identified by $\theta$ will not immediately cause the sphere to pivot about the first support edge 30 and return to its original contact with support edge 32. The reason for this failure to move back toward its original position is that the switch is provided with hysteresis of a magnitude identified by angle $\Delta$ in FIG. 4. Therefore, the switch must rotate the additional magnitude identified by angle $\Delta$ until it reaches the point identified by reference numeral 66. At this point of rotation, the center of gravity of the sphere is again directly above the first support edge 30 and the sphere again achieves an unstable position which will cause it to rotate counterclockwise about the support edge 30 and return toward contact with both support edges, 30 and 32. The sphere then rotates into conducting association with the other support edge 32 and achieves the position identified by reference numeral 68 in FIG. 6. Continued movement in the same direction by the switch will merely decrease the magnitude of the tilt angle while maintaining the conducting status of the switch. It should be realized that continued rotation of the switch in a counterclockwise will eventually cause the sphere to pivot about support edge 32 and disconnect from support edge 30.

It should be apparent from the above description that several attributes of the present invention distinguish it from tilt switches known in the prior art. First, although the sphere 36 of the switch 10 is not rigidly attached to the first or second conductive end caps, its normal movement consists of a pivoting motion about support edge 30 while maintaining consistent contact with support edge 30. In other words, the movement of the sphere 36 relative to the end caps is not one of rolling but, instead, the movement is one of pivoting. Continued tilting of the switch 10 in one direction and then another will cause the sphere 36 to move from its first position to its second position and then back again to its first position without causing the support edge 30 to move out of contact with one particular location on the surface of the sphere 36. While it is recognized that the support edges can be slightly rounded to permit ease of operation under certain conditions, it should be realized that the sphere 36 does not roll out of contact with the vicinity of the edge. This avoids one of the most serious drawbacks of the use of a sphere in a tilt switch that conducts current through the sphere. Even if the sphere 36 of the present invention becomes slightly pitted, because of an arcing condition during the making and breaking of electrical connection, the pitting will not significantly interfere with the rolling of the sphere because the operation of the present invention does not require the sphere to roll during its normal operation.

It should also be apparent that the present invention accomplishes its functions and purposes through the use of a switch which incorporates simple components that are easily manufactured and which are relatively inexpensive to manufacture.

Figure 7:
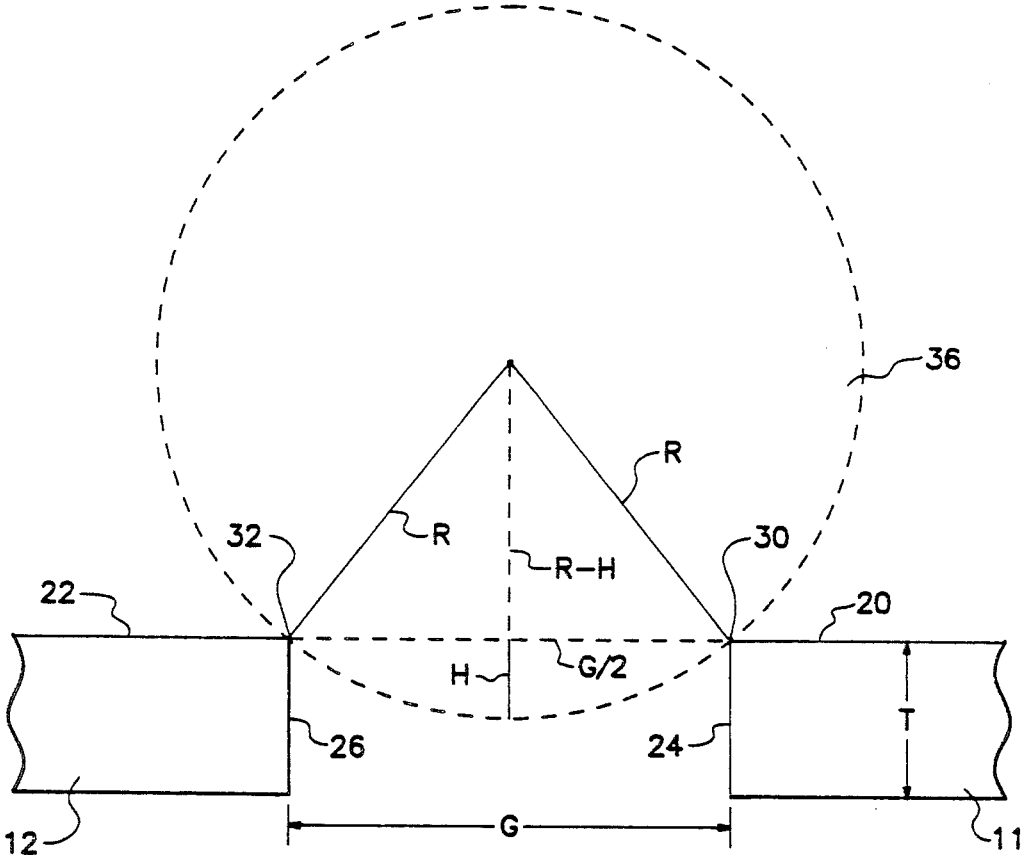
FIG. 7 shows the relationship between the gap and the required thickness of an insulative tube.

FIG. 7 shows the relationship between the radius of the sphere 36, the magnitude of the gap G, the thickness T of the relevant portions of the end caps, 11 and 12, and the radial dimension H of the sphere that extends beyond the inner cylindrical surfaces, 20 and 22. The relationship between G and R must be such that H is less than T. Otherwise, the sphere 36 will be in contact with the nonconductive tube 14 and its normal contact with the support edges, 30 and 32, will be deleteriously affected when the sphere is in its first position. The dimension H is given by $$H = R - (0.5)(4R^2 - G^2)^{\frac{1}{2}}$$

which defines the magnitude of H which must be less than thickness T.

Figure 8:
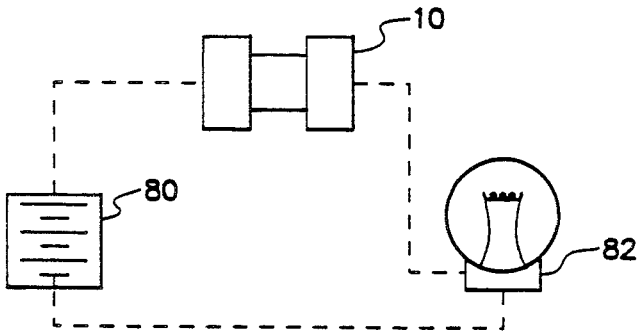
FIG. 8 illustrates one particular application of the present invention.

FIG. 8 illustrates one particular application for which the present invention is especially well suited. The switch 10 is connected in electrically serial relationship with a power source 80 which can be a battery as illustrated in FIG. 8. Also connected in series with the switch 10 and power source 80 is a lamp 82 which provides illumination when receiving power from the power source 80. FIG. 8 is a highly schematic and simplified illustration of one application of the present invention. This type of application can be used in an automobile to activate and deactivate a light source in the trunk lid of the automobile or connected to the hood of the automobile. However, it should be understood that the present invention is not limited to automotive applications but, instead, can find utility in any one of many circuits which require the ability to complete or break the circuit in response to changes in tilt or attitude of a particular component.

Although the present invention has been described and illustrated in significant detail, it should be understood that alternative embodiments are within its scope.

The embodiments of the invention in which an exclusive property or right is claimed are defined as follows:

1. A tilt switch, comprising:

a first end cap, said first end cap being electrically conductive and having a first support edge;

a second end cap, said second end cap being electrically conductive and having a second support edge, said first and second end caps being associated together with said first and second support edges spaced apart to define a predetermined gap therebetween; and a conductive sphere disposed between said first and second end caps, said conductive sphere being moveable, in response to a first change in attitude of said switch, between a first position and a second position, said first position being defined by said sphere being in electrical contact with both of said first and second support edges with said sphere being supported by said first and second edges and bridging said gap, said second position being defined by said sphere being in electrical noncontact with said second edge, said sphere being pivotable about said first edge between said first and second positions.

2. The switch of claim 1, wherein:

said first end cap further comprises a first support point, said first support point being positioned to cooperate with said first support edge to support said sphere in said second position.

3. The switch of claim 2, further comprising:

an electrically nonconductive member connected between said first and second end caps.

4. The switch of claim 3, wherein:

said electrically nonconductive member is a tube, said sphere being disposed within said tube, said first and second support edges being disposed within said tube.

5. The switch of claim 4, wherein:

said first end cap is generally tubular and said first support edge is a portion of an inner diametrical surface of said generally tubular first end cap.

6. The switch of claim 5, wherein:

said first and second end caps are connected in electrically serial association with a source of electrical energy and a source of illumination, wherein said sphere is movable to complete an electrical circuit when in said first position and to break said electrical circuit when in said second position.

7. The switch of claim 6, wherein:

said tube is plastic.

8. The switch of claim 6, wherein:

said tube is ceramic.

9. The switch of claim 6, wherein:

said tube is filled with a nonconductive liquid.

10. The switch of claim 2, wherein:

said second end cap further comprises a second support point, said second support point being positioned to cooperate with said second support edge to support said sphere in a third position, said third position being defined by said sphere being in electrical noncontact with said first support edge of said first end cap, said sphere being movable into said third position in response to a second change in attitude of said switch.

11. A tilt switch, comprising:

a first end cap, said first end cap being electrically conductive;

a second end cap, said second end cap being electrically conductive;

a tube, said tube being disposed between and attached to said first and second end caps, said tube being electrically nonconductive, an inward portion of said first end cap and an inward portion of said second end cap extending toward each other within said tube and spaced apart by a predefined gap; and a generally spherical conductor disposed within said tube, said spherical conductor being movable between first and second positions in response to movement of said switch, said first position being in conductive bridging association with said inward portions of said first and second end caps across said predefined gap, said second position being in noncontact relation with one of said first and second end caps, said spherical conductor being pivotable about one of said inward portions of said first and second end caps between said first and second positions.

12. The switch of claim 11, wherein:

said first end cap is generally tubular and said first portion of said first end cap is a part of an inner surface of said generally tubular first end cap.

13. The switch of claim 12, wherein:

said first end cap further comprises a support point which supports said sphere in cooperation with said inward portion of said first end cap when said sphere is in said second position.

14. The switch of claim 13, wherein:

said first and second end caps are connected in electrical series relation with a source of electrical power and a lamp.

15. A tilt switch, comprising:

a first conductive end piece;

a second conductive end piece, said first conductive end piece being generally tubular and having a portion of a first inner cylindrical surface extending toward said second conductive end piece, said second conductive end piece being generally tubular and having a portion of a second inner cylindrical surface extending toward said first conductive end piece;

a hollow central member disposed between said first and second end pieces, said first and second end pieces being disposed in electrical nonconductive association with each other; and a conductive element disposed within said hollow central member, said conductive element being pivotable in response to movement of said switch between a first position in bridging association between said first and second conductive end pieces and a second position in nonconducting association with at least one of said first and second conductive end pieces.

16. The tilt switch of claim 15, wherein:

said hollow central member is a nonconductive tube.

17. The tilt switch of claim 15, wherein:

said conductive element is a spherical metal ball.

18. The tilt switch of claim 15, wherein:

a preselected one of said first and second conductive end pieces is connected in electrical communication with a source of electrical energy and the other one of said first and second conductive end pieces is connected to an electrically energizable light source.

19. The switch of claim 15, wherein:

said first conductive end cap comprises a support point which supports said conductive element in cooperation with said portion of said first inner cylindrical surface when said conductive element is disposed in said second position.

* * * * *